US007351101B1

(12) United States Patent
Montena

(10) Patent No.: US 7,351,101 B1
(45) **Date of Patent: *Apr. 1, 2008**

(54) COMPACT COMPRESSION CONNECTOR FOR ANNULAR CORRUGATED COAXIAL CABLE

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/709,363

(22) Filed: Feb. 22, 2007

Related U.S. Application Data

(63) Continuation-in-part of application No. 11/505,961, filed on Aug. 17, 2006.

(51) Int. Cl.
*H01R 9/05* (2006.01)

(52) U.S. Cl. ..... 439/584

(58) Field of Classification Search ..... 439/584, 439/585, 578

See application file for complete search history.

(56) References Cited

U.S. PATENT DOCUMENTS

| | | | |
|---|---|---|---|
| 3,328,746 | A | 6/1967 | Schumacher |
| 3,449,706 | A | 6/1969 | Carissimi |
| 3,520,342 | A | 7/1970 | Scheffer |
| 3,530,425 | A | 9/1970 | Vachhani |
| 3,668,612 | A | 6/1972 | Nepovim |
| 3,910,673 | A | 10/1975 | Stokes |
| 3,963,321 | A | 6/1976 | Burger et al. |
| 4,046,451 | A | 9/1977 | Juds et al. |
| 4,126,170 | A | 11/1978 | DeHaitre |
| 4,138,198 | A | 2/1979 | Brown |
| 4,173,385 | A | 11/1979 | Fenn et al. |
| 4,241,967 | A | 12/1980 | Collins |
| 4,296,950 | A | 10/1981 | Chamberlin |
| 4,367,060 | A | 1/1983 | Berecz |
| 4,433,889 | A | 2/1984 | Ratchford et al. |
| 4,447,103 | A | 5/1984 | Werth et al. |
| 4,549,755 | A | 10/1985 | Kot et al. |
| 4,659,272 | A | 4/1987 | Pratt |
| 4,674,818 | A | 6/1987 | McMills et al. |
| 4,687,272 | A | 8/1987 | Spinner et al. |
| 4,717,355 | A | 1/1988 | Mattis |
| 4,824,400 | A | 4/1989 | Spinner |

(Continued)

FOREIGN PATENT DOCUMENTS

| | | |
|---|---|---|
| GB | 2277207 | 10/1994 |

OTHER PUBLICATIONS

U.S. Appl. No. 11/505,961, filed Aug. 17, 2006, Jackson et al.

(Continued)

*Primary Examiner*—Neil Abrams
*Assistant Examiner*—Phuongchi Nguyen
(74) *Attorney, Agent, or Firm*—Marjama Muldoon Blasiak & Sullivan, LLP

(57) ABSTRACT

A compression connector for the end of an annular corrugated coaxial cable is provided wherein the compression connector includes a clamp having a plurality of through slots and a spring to enable the cable to be positioned so as to be securely engageable to/within the connector without causing deformation of the cable and also to allow the cable to be prepared by being cut at a corrugation valley rather than a corrugation peak.

43 Claims, 4 Drawing Sheets

U.S. PATENT DOCUMENTS 4,824,401 A 4/1989 Spinner
4,842,553 A 6/1989 Ingram
4,869,679 A 9/1989 Szegda
4,902,246 A 2/1990 Samshisen
4,907,924 A 3/1990 Hellon
4,960,342 A 10/1990 Chi
4,995,832 A 2/1991 Thommen et al.
5,011,432 A 4/1991 Sucht et al.
5,120,260 A 6/1992 Jackson
5,127,853 A 7/1992 McMills et al.
5,137,470 A 8/1992 Doles
5,154,636 A 10/1992 Vaccaro et al.
5,167,533 A 12/1992 Rauwolf
5,267,877 A 12/1993 Scannelli et al.
5,283,853 A 2/1994 Szegda
5,284,449 A 2/1994 Vaccaro
5,322,454 A 6/1994 Thommen
5,334,051 A 8/1994 Devine et al.
5,342,096 A 8/1994 Bachle et al.
5,354,217 A * 10/1994 Gabel et al. ..... 439/584
5,435,745 A 7/1995 Booth
5,454,675 A 10/1995 DeHaitre
5,518,420 A 5/1996 Pitschi
5,561,900 A 10/1996 Hosler, Sr.
5,571,028 A 11/1996 Szegda
5,662,489 A 9/1997 Stirling
5,681,189 A 10/1997 Dunham
5,722,856 A 3/1998 Fuchs et al.
5,766,037 A 6/1998 Nelson
5,795,188 A 8/1998 Harwath
5,802,710 A 9/1998 Bufanda et al.
5,830,009 A 11/1998 Tettinger
5,857,865 A 1/1999 Shimirak et al.
5,866,849 A 2/1999 Tuvy et al.
5,938,474 A 8/1999 Nelson
5,944,556 A 8/1999 Wlos et al.
5,980,315 A 11/1999 Matsuda et al.
5,984,723 A 11/1999 Wild
5,993,254 A 11/1999 Pitschi et al.
5,997,350 A 12/1999 Burris et al.
6,019,635 A 2/2000 Nelson
6,019,636 A 2/2000 Langham
6,032,358 A 3/2000 Wild
6,053,749 A 4/2000 Masuda et al.
6,080,015 A 6/2000 Andreescu
6,102,737 A 8/2000 Gohdes
D436,076 S 1/2001 Montena
D437,826 S 2/2001 Montena
D440,539 S 4/2001 Montena
D440,939 S 4/2001 Montena
6,234,838 B1 5/2001 Wong
6,293,824 B1 9/2001 Guerin et al.
6,298,190 B2 10/2001 Waldron et al.
6,386,915 B1 5/2002 Nelson
6,431,911 B2 8/2002 Pitschi
6,471,545 B1 10/2002 Hosler, Sr.
6,491,546 B1 12/2002 Perry
6,619,876 B2 9/2003 Vaitkus et al.
RE38,294 E 11/2003 Nattel et al.
6,692,300 B2 2/2004 Kanda et al.
6,733,336 B1 5/2004 Montena et al.
6,783,394 B1 8/2004 Holliday
6,808,415 B1 * 10/2004 Montena ..... 439/584
6,830,479 B2 12/2004 Holliday
6,840,803 B2 1/2005 Wlos et al.
6,848,941 B2 2/2005 Wlos et al.
6,884,113 B1 4/2005 Montena
6,929,265 B2 8/2005 Holland et al.
6,939,169 B2 9/2005 Islam et al.
6,976,872 B1 12/2005 Wild et al.
7,070,447 B1 7/2006 Montena
7,131,868 B2 * 11/2006 Montena ..... 439/578
7,156,696 B1 * 1/2007 Montena ..... 439/584
7,189,115 B1 3/2007 Montena
2004/0219821 A1 11/2004 Makita et al.
2004/0253870 A1 12/2004 Johnson
2005/0026496 A1 2/2005 Islam et al.
2005/0159044 A1 7/2005 Harwath et al.
2005/0181652 A1 8/2005 Montena et al.
2006/0014427 A1 1/2006 Islam et al.

OTHER PUBLICATIONS

U.S. Appl. No. 11/709,363, filed Feb. 22, 2007, Montena.
U.S. Appl. No. 11/709,368, filed Feb. 22, 2007, Montena.

* cited by examiner

COMPACT COMPRESSION CONNECTOR FOR ANNULAR CORRUGATED COAXIAL CABLE

FIELD OF THE INVENTION

This invention relates in general to terminals for coaxial cables, and, more particularly, to compact compression connectors that include a clamp with a plurality of through slots in order to facilitate snug, yet non-deforming engagement of such a connector to a segment of annular corrugated coaxial cable.

BACKGROUND OF THE INVENTION

Coaxial cable is being deployed on a widespread basis in order to carry signals for communications networks, e.g., CATV and computer networks. All types of coaxial cable must at some point be connected to network equipment ports. In general, it has proven difficult to adequately make such connections without requiring labor intensive effort by highly skilled technicians. Moreover, even if careful attention is paid during installation, there still can be set up errors, which, in turn, can moderately to severely affect signal quality.

These generalized problems are likewise encountered with respect to corrugated coaxial cable (e.g., spiral, helical and annular corrugated coaxial able), which, however, also poses its own set of unique installation issues. Most notably, corrugated coaxial cable, due to its design, has proven to be challenging to properly engage to a connector, especially in a field installation setting.

Annular corrugated coaxial cable includes a plurality of corrugation ridges (i.e., peaks) on its outer conductor, wherein a recessed valley is defined between adjoining peaks. This design makes it beneficial for annular corrugated coaxial cable to be incorporated in installation settings such as those in which a particular combination of flexibility, strength and moisture resistance is desired.

Ideally, following installation of annular corrugated coaxial cable, a connector would snugly engage the outer conductor of the segment of the annular corrugated coaxial cable within the valleys and around the adjoining peaks of the cable. Such positioning ensures maximum surface contact between the connector and the cable, yet also minimizes the likelihood of surface deformation of the cable, as would likely occur if contact was instead made partially on one or more peaks.

Unfortunately, this ideal positioning rarely occurs in practice due to various factors, such as the design of the portion of the connector that contacts the outer conductor of the annular corrugated coaxial cable. At present, connectors for annular corrugated coaxial cable often include a clamping mechanism to facilitate or enable the engagement of the connector to the cable. An exemplary such clamping mechanism is a C-shaped split ring, wherein its C-shaped design, in theory, is supposed to enable it to expand its outer diameter to pass over corrugation peaks and then to reduce its inner diameter so as clamp down onto a corrugation valley. An exemplary C-shaped split ring clamp is described in U.S. Pat. No. 5,284,449 to Vaccaro, the entirety of which is incorporated by reference herein. In practice, however, a C-shaped split ring rarely ends up being situated in a valley of annular corrugated coaxial cable, instead contacting the outer conductor of the cable entirely or partially on a peak. That, in turn, creates high contact forces, which, unless corrected (e.g., by taking added time and effort to wedge a supporting structure under the outer conductor), will cause the peak to collapse and lessen the electrical contact between the connector and the cable.

Another problem with current installation techniques for annular corrugated coaxial cable is that when preparing the cable segment for engagement to a connector, an installer must cut the cable segment precisely at one of its peaks. This is shown, e.g., in U.S. Patent Application Publication No. 2005/0159043 A1 to Harwath et al., the entirety of which is incorporated by reference herein. In particular, FIG. 1 of the Harwath et al. publication depicts a segment of annular corrugated coaxial cable (see reference numeral 1) having been cut and flared at a peak (see reference numeral 17) in preparation for engagement to a connector.

It is difficult to achieve a cut precisely at a corrugation peak of annular corrugated coaxial cable under any circumstances, but especially in a field setting. During field installation, an installer will need to use several intricate tools and cutting guides to assist in making an accurate cut at a peak, and even then there is no guarantee that the cut will be made satisfactorily. Moreover, after these exhaustive field installation steps are taken, the resulting engagement between the cable and the connector still might not actually occur at the correct position, e.g., due to usage of a C-shaped split ring clamping mechanism.

Thus, there is a need for a connector for annular corrugated coaxial cable, wherein the connector includes an improved clamping mechanism design that not only requires far less exacting installation, but which also ensures that the resulting engagement between the connector and the annular corrugated coaxial cable will occur within a corrugation valley.

SUMMARY OF THE INVENTION

These and other needs are met by a compact compression connector for annular corrugated coaxial cable. The annular corrugated coaxial cable includes a center conductor that has a surrounding dielectric, which itself is surrounded by an outer conductor that is in the form of a plurality of conductive peaks and a plurality of conductive valleys, wherein the outer conductor is at least partially surrounded by a protective outer sheath/jacket.

By way of non-limiting example, the connector includes an opening and can comprise (a) a body that has a first end, a second end and a bore defined therebetween, (b) a compression member (e.g., a housing) that has a first end, a second end and a bore defined therebetween, wherein the second end of the compression member is in tactile communication with the body of the connector, and (c) a clamping element (e.g., a clamp) disposed within the bore of the body and in tactile communication with the body, wherein the clamping element comprises: a first end; a second end; a bore defined between the first end and the second end of the clamping element; a plurality of through slots; a plurality of peaks; and a plurality of valleys. Upon axial advancement of the compression member in a direction away from the opening of the connector (i.e., toward the second end of the connector body), the clamping element is caused to be compressed radially to an extent whereby at least one of the plurality of peaks of the clamping element becomes engaged within one of the plurality of valleys of the annular corrugated coaxial cable and whereby at least one of the plurality of peaks of the annular corrugated coaxial cable becomes engaged within one of the plurality of valleys of the clamping element so as to provide at least one contact force between the compression connector and the annular corrugated coaxial cable.

By way of a related non-limiting example, the bore of the body can include a sloped surface and the second end of the clamping element can include a sloped surface as well, wherein the sloped surface of the second end of the clamping element is complimentary to the sloped surface of the body. Moreover, if desired, the clamping element can include at least three through slots.

Also by way of a related non-limiting example, the second end of the body can include a connector interface selected from the group of connector interfaces consisting of a BNC connector, a TNC connector, an F-type connector, an RCA-type connector, a DIN male connector, a DIN female connector, an N male connector, an N female connector, an SMA male connector and an SMA female connector.

By way of a further related non-limiting example, the connector can include a nut that surrounds the second end of the body and that can be hex-shaped. When a nut is present, and if desired, the body can further include a protruding ridge against which the nut is disposed.

Also by way of a further related non-limiting example, the connector can include a driving member that has a first end, a second end and a bore defined therebetween, wherein the driving member is disposed within the bore of the body and is in tactile communication with the body. If desired, the driving member can include a protruding ridge positioned so as to act as a stop for the first end of the body. Also if desired, the bore of the driving member can include a sloped surface and the first end of the clamping element can include a sloped surface that is complimentary to the sloped surface of the driving member.

By way of a still further related non-limiting example, the connector can include an intermediate member (e.g., a grommet) disposed within the connector between the driving member and the compression member. Generally, but not necessarily, the intermediate member is formed of a reversibly compressible material, e.g., an elastomeric material such as silicone rubber, such that upon a predetermined axial movement of the first end of the body in a direction away from the opening of the connector the intermediate member can be radially compressed so as to exert a force against the outer protective jacket of the annular corrugated coaxial cable.

Also by way of a still further non-limiting example, the connector can include a coiled element (e.g., a spring) in communication with the clamping element, wherein the coiled element has a first end, a second end, and a predetermined amount of space defined between the first end and the second end, and wherein the predetermined amount of space is reduced as radial pressure is being exerted upon the coiled element. If desired, the coiled element can be disposed within a recess defined within the clamping element (e.g., within a valley of the clamping element).

By way of a yet still further related non-limiting example, the connector can include a collet and a spacer (e.g., an insulator). If desired, the collet can be disposed within the bore of the body and can be adapted to receive the center conductor of the annular corrugated coaxial cable so as to establish electrical connectivity between the collet and the center conductor. Also if desired, the spacer can be disposed at a predetermined position between the collet and the body such that the center conductor of the annular corrugated coaxial cable is electrically isolated from the body.

Also by way of a yet still further related non-limiting example, the connector can include a guide element (e.g., a seizure bushing), which is in tactile communication with the body and includes a first end, a second end and a bore defined therebetween, wherein the bore of the guide element is sized to accommodate the center conductor of the annular corrugated coaxial cable and wherein the guide element is positioned within the bore of the body so as to guide the center conductor of the annular corrugated coaxial cable into the collet, if included. If desired, the guide element can have an outer diameter that tapers inwardly from the first end of the guide element to the second end of the guide element. Also if desired, the bore of the guide element can have a substantially constant inner diameter that is substantially equal to the outer diameter of the guide element at the second end of the guide element.

By way of another non-limiting example, the connector includes an opening and can comprise (a) a body that has a first end, a second end and a bore defined therebetween; (b) a compression member that has a first end, a second end and a bore defined therebetween, wherein the second end of the compression member is in tactile communication with the body, (c) a driving member that has a first end, a second end and a bore defined therebetween, wherein the driving member is disposed within the bore of the body and is in tactile communication with both the body and the compression member, and (d) a clamping element disposed within the bore of the body and in tactile communication with the body, wherein the clamping element comprises: a first end; a second end; a bore defined between the first end and the second end of the clamping element; a plurality of through slots; a plurality of peaks; and a plurality of valleys. Upon axial advancement of the compression member in a direction away from the opening of the connector the clamping element is caused to be compressed radially by at least the driving member to an extent whereby at least one of the plurality of peaks of the clamping element becomes engaged within one of the plurality of valleys of the annular corrugated coaxial cable and whereby at least one of the plurality of peaks of the annular corrugated coaxial cable becomes engaged within one of the plurality of valleys of the clamping element so as to provide at least one contact force between the compression connector and the annular corrugated coaxial cable.

By way of yet another non-limiting example, the connector includes an opening and can comprise (a) a body that has a first end, a second end and a bore defined therebetween, (b) a compression member that has a first end, a second end and a bore defined therebetween, wherein the second end of the compression member is in tactile communication with the body and wherein the compression member surrounds at least the first end of the body, (c) a driving member that has a first end, a second end and a bore defined therebetween, wherein the driving member is disposed within the bore of the body and is in tactile communication with the body, (d) an intermediate member that has a first end, a second end and a bore defined therebetween, wherein the intermediary member is disposed within the bore of the body between the compression member and the driving member, and (e) a clamping element disposed within the bore of the body and in tactile communication with the body, wherein the clamping element comprises: a first end; a second end; a bore defined between the first end and the second end of the clamping element; a plurality of through slots; a plurality of peaks; and a plurality of valleys. Upon axial advancement of the compression member in a direction away from the opening of the connector (a) the clamping element is caused to be compressed radially to an extent whereby at least one of the plurality of peaks of the clamping element becomes engaged within one of the plurality of valleys of the annular corrugated coaxial cable and whereby at least one of the plurality of peaks of the annular corrugated coaxial cable becomes engaged within one of the plurality of valleys of the clamping element so as to provide at least one contact force between the compression connector and the annular corrugated coaxial cable, and (b) the intermediate member is caused to be compressed radially between the compression member and the driving member to an extent so as to provide at least one contact force against the outer protective jacket of the annular corrugated coaxial cable.

By of still another non-limiting example, the connector includes an opening and can comprise (a) a body that has a first end, a second end and a bore defined therebetween, wherein the bore of the body includes a sloped surface, (b) a compression member that has a first end, a second end and a bore defined therebetween, wherein the second end of the compression member is in tactile communication with the body and wherein the compression member surrounds at least the first end of the body, (c) a driving member that has a first end, a second end and a bore defined therebetween, wherein the bore of the driving member includes a sloped surface, and wherein the driving member is disposed within the bore of the body and is in tactile communication with the body, (d) an intermediate member having a first end, a second end and a bore defined therebetween, wherein the intermediary member is disposed within the bore of the body between the compression member and the driving member, and (e) a clamping element disposed within the bore of the body and in tactile communication with the body, wherein the clamping element comprises: a first end having a sloped surface complimentary to the sloped surface of the driving member; a second end having a sloped surface complimentary to the sloped surface of the body; a bore defined between the first end and the second end of the clamping element; a plurality of through slots; a plurality of peaks; and a plurality of valleys. Upon axial advancement of the compression member in a direction away from the opening of the connector (a) the sloped surface of the first end of the clamping element is caused to contact the sloped surface of the driving member and the sloped surface of the second end of the clamping element is caused to contact the sloped surface of the body so as to collectively radially compress the clamping element to an extent whereby at least one of the plurality of peaks of the clamping element becomes engaged within one of the plurality of valleys of the annular corrugated coaxial cable and whereby at least one of the plurality of peaks of the annular corrugated coaxial cable becomes engaged within one of the plurality of valleys of the clamping element so as to provide at least one contact force between the compression connector and the annular corrugated coaxial cable; and (b) the intermediate member is caused to be compressed radially between the compression member and the driving member to an extent so as to provide at least one contact force against the outer protective jacket of the annular corrugated coaxial cable.

By way of still yet another non-limiting example, the connector includes an opening and can comprise (a) a body that has a first end, a second end and a bore defined therebetween, (b) a compression member that has a first end, a second end and a bore defined therebetween, wherein the second end of the compression member is in tactile communication with the body, and (c) a clamping element that is disposed within the bore of the body and in tactile communication with the body, wherein the clamping element comprises: a first end; a second end; a bore defined between the first end and the second end of the clamping element; a plurality of peaks; a plurality of valleys; and at least three clamping element segments separated from each other, wherein at least two of the three clamping element segments are separated from each other by at least one piece of material located between the first end of the clamping element and the second end of the clamping element. Upon axial advancement of the compression member in a direction away from the opening of the connector, the clamping element is caused to be compressed radially to an extent whereby (a) at least one piece of material is broken apart such that a through slot is defined between the first end and the second end of the clamping element where the at least one piece of material was formerly located, and (b) at least one of the plurality of peaks of the clamping element becomes engaged within one of the plurality of valleys of the annular corrugated coaxial cable and whereby at least one of the plurality of peaks of the annular corrugated coaxial cable becomes engaged within one of the plurality of valleys of the clamping element so as to provide at least one contact force between the compression connector and the annular corrugated coaxial cable.

Still other aspects, embodiments and advantages of these exemplary aspects are discussed in detail below. Moreover, it is to be understood that both the foregoing general description and the following detailed description are merely illustrative examples of various embodiments, and are intended to provide an overview or framework for understanding the nature and character of the claimed embodiments. The accompanying drawings are included to provide a further understanding of the various embodiments, and are incorporated in and constitute a part of this specification. The drawings, together with the description, serve to explain the principles and operations of the described and claimed embodiments.

BRIEF DESCRIPTION OF THE DRAWINGS

For a fuller understanding of the nature and desired objects of the present invention, reference is made to the following detailed description taken in conjunction with the accompanying figures, wherein like reference characters denote corresponding parts throughout the views, and in which.

DETAILED DESCRIPTION OF THE INVENTION

Figure 1:
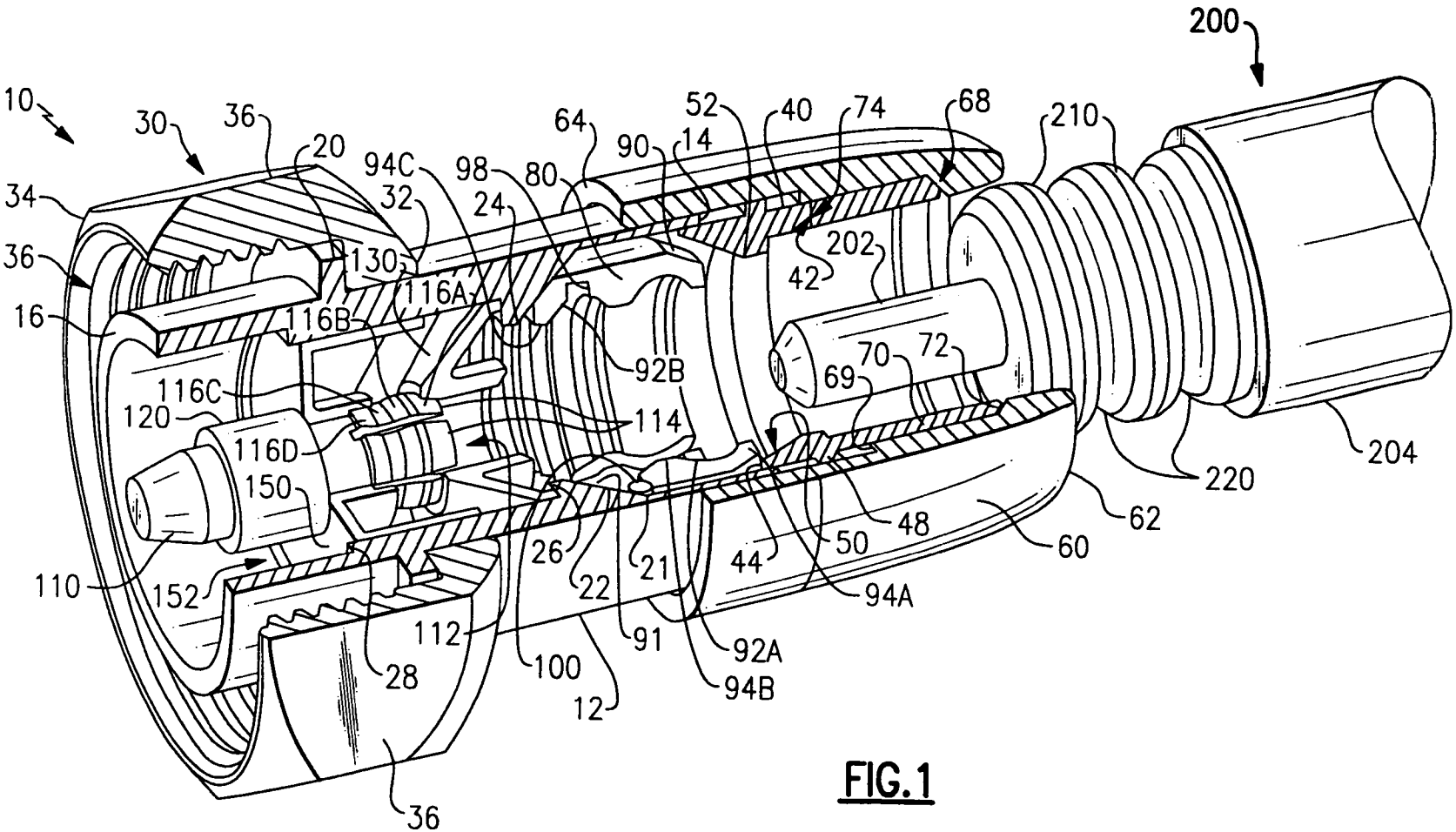
FIG. 1 is a cutaway perspective view of an exemplary compression connector during insertion of a segment of annular corrugated coaxial cable therewithin.
Figure 2:
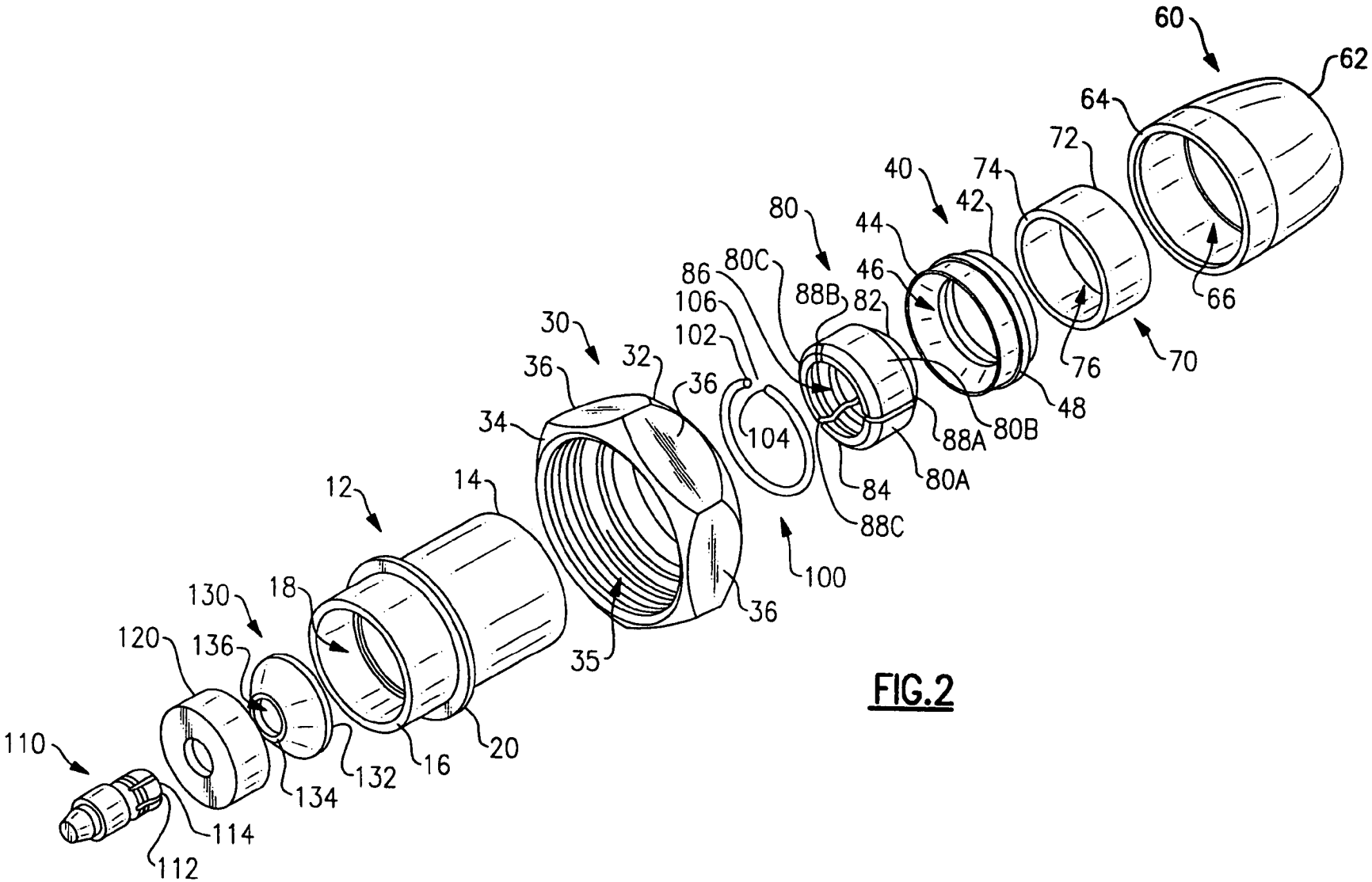
FIG. 2 is an exploded perspective view of the compression connector of FIG. 1.

Referring initially to FIGS. 1 and 2, an exemplary compression connector 10 is illustrated, wherein the connector 10 has an opening 11 into which a segment of annular corrugated coaxial cable 200 is to be inserted. The coaxial cable segment 200 includes a protruding center conductor 202, an outer protective jacket 204, a plurality of conductive corrugation peaks 210, and a plurality of conductive valleys 220. The compression connector 10 is advantageous in that it is simple to install in a factory or field setting and it is reliably effective at establishing and maintaining strong contact forces between the connector and the segment of annular corrugated coaxial cable 200 yet while causing little to no deformation of the cable.

Although the connector 10 is depicted in the Figures as having a DIN male connector interface, it can have other interfaces as well without undue experimentation. Such other interfaces include, but are not limited to, a BNC connector interface, a TNC connector interface, an F-type connector interface, an RCA-type connector interface, a DIN female connector interface, an N male connector interface, an N female connector interface, an SMA male connector interface, and an SMA female connector interface.

The compression connector 10 includes a connector body 12, which has a first end 14, a second end 16 and a continuous bore 18 defined therebetween. It is understood that the terms "first end" and "second end" are used herein to refer to opposite ends of an element or object, wherein the "first end" is positioned comparatively closer to the opening 11 of the connector 10 than the "second end."

The connector body 12 has a generally cylindrical shape, but also includes a protruding ridge/ring 20 that surrounds the outer periphery of the connector body. The location of the ridge 20 can vary; however, in accordance with at least the exemplary embodiments shown in FIGS. 1 and 2, the ridge 20 is located comparatively closer to the second end 16 of the body 12.

The inner diameter of the bore 18 of the connector body 12 can be constant or, as shown in FIG. 1, can vary. In at least the FIG. 1 exemplary embodiment, the inner diameter of the bore 18 of the body 12 is substantially constant between its first end 14 and a first inner diameter transition point 21, at which the inner diameter of the bore tapers inwardly to define a sloped/ramped surface 22. The angle of taper of the sloped surface 22 can vary; however, it is currently preferred for it to be substantially constant and to be between about 30° and about 60°, wherein an angle of about 45° is illustrated in FIG. 1. Also by way of non-limiting example and as depicted in FIG. 1, there can be substantially constant inner diameter portions of the bore 18 of the body 12 between the sloped surface culmination point 24 and a second inner diameter transition point 26, between the second inner diameter transition point 26 and a third inner diameter transition point 28, and/or between the third inner diameter transition point 28 and the second end 16 of the body 12.

The actual inner diameter of the bore 18 of the body 12 can be the same or different for any or all of the substantially constant inner diameter portions. However, by way of non-limiting example and as shown in FIG. 1, the inner diameter of the bore at the substantially constant inner diameter portion between the sloped surface culmination point 24 and the second inner diameter transition point 26 is less than the inner diameter of the bore at the substantially constant inner diameter portion between the second inner diameter transition point and the third inner diameter transition point 28, which, in turn, is less than the inner diameter of the bore at the substantially constant inner diameter portion between the third inner diameter transition point and the second end 16 of the body 12, which, in turn, is less than the inner diameter of the bore at the substantially constant inner diameter portion between the first end 14 of the body 12 and the first inner diameter transitional point 21.

As shown in FIG. 1, the second end 16 of the connector body 12 is surrounded by a nut 30, which has a first end 32, a second end 34 and a continuous, threaded bore 35 defined therebetween. Generally, the nut 30 is hex-shaped and includes a plurality of sides/flats 36 to enable the nut to be grasped and manipulated by a tool (not shown) or by hand when coupling the compression connector 10 to a complimentary fitting (not shown) on an equipment port (not shown) to which the cable segment 200 is to be connected.

The nut 30 is retained within its illustrated position in FIG. 1 by being disposed against the ridge 20 of the connector body 12. Although not shown in the Figures, a nut retaining element (e.g., a retaining ring) can be disposed around the connector body 12 and adjacent to the first end 32 of the nut 30 so as to provide added assurance that the nut will be retained in its FIG. 1 position.

Figure 3:
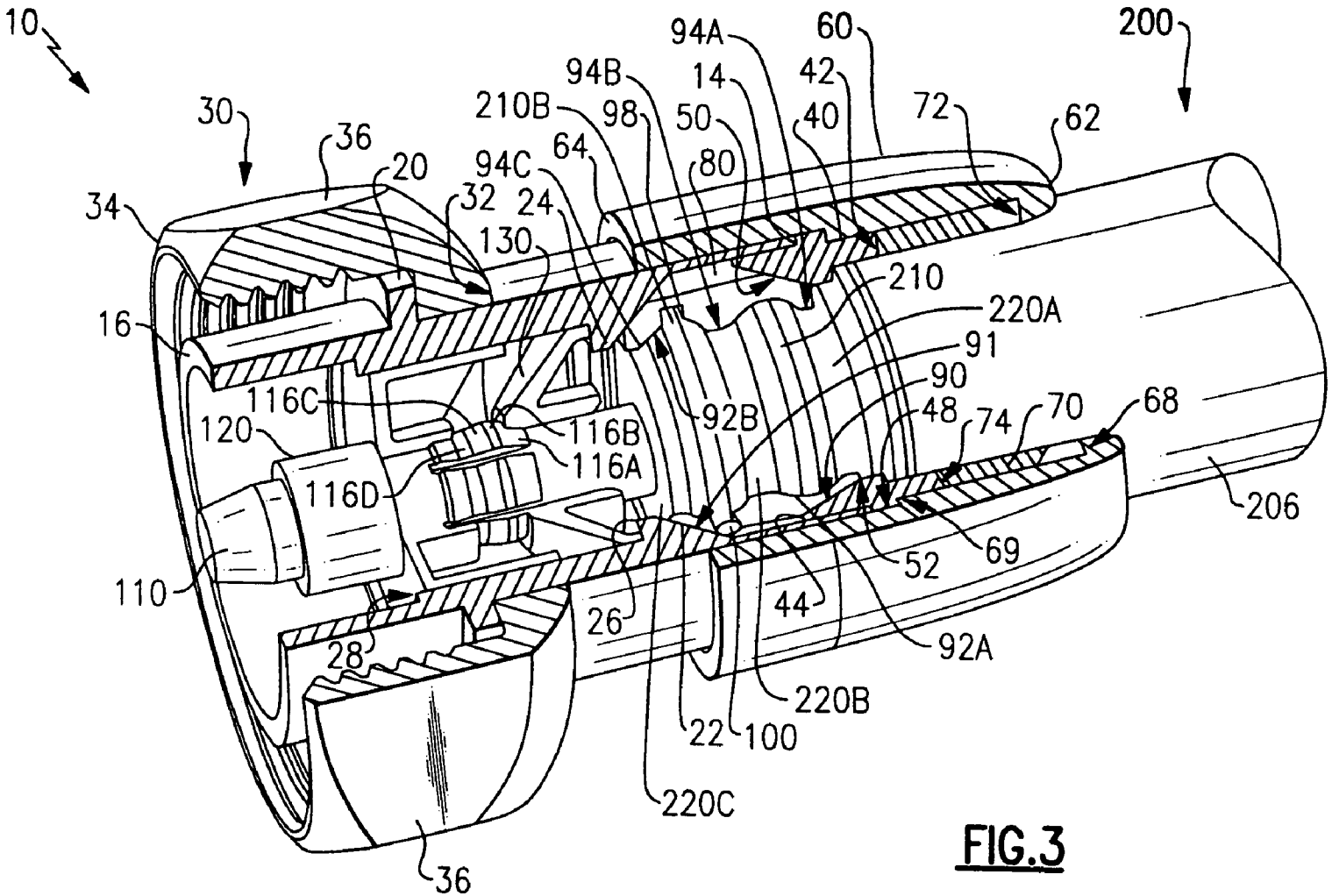
FIG. 3 is a cutaway perspective views of the compression connector of FIG. 1 after a segment of annular corrugated coaxial cable has been fully inserted therein and compressed.

The body 12 of the connector 10 is in tactile communication with a driving member 40, which has a first end 42, a second end 44 and a continuous bore 46 defined therebetween. The driving member 40 includes a protruding ring/ridge 48 that surrounds the outer periphery of the driving member. The location of the ridge 48 can vary; however, in accordance with at least the exemplary embodiments depicted in the Figures, the ridge is located at about the midpoint between the first end 42 and the second end 44 of the driving member 40. As will be explained in further detail below, and as is shown in FIG. 3, a purpose of the ridge 48 is to act as a stop for the first end 14 of the body 12 when the connector 10 is compressed to engage the segment of annular corrugated coaxial cable 200.

The driving member 40 includes a sloped/ramped surface 50 within its bore 46, wherein the inner diameter of the bore at this sloped surface tapers from a taper commencement point 52 to the second end 44 of the driving member. The angle of taper of the sloped/ramped surface 50 can vary; however, it is currently preferred for it to be substantially constant and to be between about 15° and about 60°, wherein an angle of about 30° is shown in FIG. 1. As will be explained in further detail below, and as is shown in FIG. 3, a purpose of the sloped surface 50 is to contact a complimentarily sloped surface 90 of a clamp 80 during compression of the connector 10 so to cause the clamp to become snugly engaged to the segment of annular corrugated cable 200.

A compression member (e.g., a housing) 60 is disposed at least partially over the outer periphery of the connector body 12, including over the first end 14 thereof. The housing 60 includes a first end 62, a second end 64 and a continuous bore 66 defined therebetween. As is currently preferred, and as is shown in FIG. 1, the first end 62 of the housing 60 is flanged so as to define a first shoulder 68. A second shoulder 69 is defined within the bore 66 of the housing 60.

An intermediate member 70 (e.g., a grommet) is disposed between the driving member 40 and the housing 60. The intermediate member 70 includes a first end 72 disposed against the shoulder 68 of the flanged first end 62 of the housing 60, a second end 74 disposed against the first end 42 of the driving member 40, and a continuous bore 76 defined between the first end 72 and the second end 74. It is currently preferred, but not required, for the intermediate member 70 to be made of an reversibly compressible material (e.g., an elastomeric material such as silicone rubber) such that, as will be further described below, the intermediate member can provide deformable strain relief between the driving member 40 and the housing 60 and can exert radial force against the protective outer jacket 204 of the cable segment 200, thus, in turn, providing added moisture sealing.

The connector 10 further includes a clamping element ("clamp") 80 having a first end 82, a second end 84 and a continuous bore 86 defined therebetween. The diameter of the bore 86 and, as discussed below, the size and shape of the inner surface of the clamp 80 are selected so as to conform to the size and shape of the surfaces of the peaks 210 and valleys 220 of the segment of coaxial cable 200.

The clamp 80 includes a plurality of through slots 88, wherein a "through slot" is defined as a discontinuation within the clamp that spans completely from the first end 82 to the second end 84 of the clamp. The presence of a plurality of through slots 88 divides the clamp 80 into a total number of separate pieces that is equal to the total number of through slots. Thus, if the clamp 80 includes two through slots 88, then the clamp is divided into two separate pieces, whereas if the clamp includes three through slots, as shown in FIG. 2, then the clamp is divided into three separate pieces—a first clamp section 80A, a second clamp section 80B, and a third clamp section 80C, wherein the first through slot 88A is defined between the first clamp section and the second clamp section, wherein the second through slot 88B is defined between the second clamp section and the third clamp section, and wherein the third through slot 88C is defined between the third clamp section and the first clamp section.

The specific number of through slots 88 that are defined within the clamp 80 can vary according to factors such as manufacturing preference and the intended usage conditions of the connector 10. However, it is currently preferred for a clamp 80 to include at least two through slots 88 so as to increase the likelihood that the connector 10 will be ideally positioned when it is engaged to/with a segment of annular corrugated coaxial cable 200. The presence of more than two through slots 88 further increases this likelihood, especially with regard to connectors (e.g., the connector 10' shown in FIG. 4) that are utilized with larger gauges of annular corrugated coaxial cable.

Alternatively, one or more of the slots 88 of the clamp 80 can be formed so as not to be a through slot. By way of non-limiting example, one or more slots 88 can be formed to initially include one or more pieces of material, which subsequently break apart as the connector is engaged to the coaxial cable segment 200. In accordance with an exemplary such embodiment, the clamp 80 can be formed such that through slot 88A instead includes one or more pieces of material (e.g., the same material from which the remainder of the clamp is formed) that are located between the first end 82 and second end 84 of the clamp 80 and that connect the first clamp section 80A and the second clamp section 80B and/or such that through slot 88B instead includes one or more pieces of material that are located between the first end and the second end of the clamp and that connect the second clamp section and the third clamp section 88C. The one or more pieces of material have a predetermined size and thickness that are selected such that the pieces of material stay intact during assembly and installation of the connector 10, but subsequently break apart automatically due to the radial force applied to the clamp 80 as the connector is engaged to the coaxial cable segment 200. Such an embodiment is advantageous in that it beneficially enables one or more of the various clamp sections 80A, 80B, 80C to be held together by the pieces of material during assembly of the clamp 80, thus preventing misplacement or loss of what would otherwise be separate pieces 80A, 80B, 80C if through slots 88 were present, but it also beneficially allows through slots 88 to be subsequently formed due to the pieces of material breaking apart on account of radial forces encountered during the steps of engaging the connector 10 to the coaxial cable segment 200, thus increasing the likelihood that the connector 10 will be ideally positioned when it is engaged to/with a segment of annular corrugated coaxial cable 200.

Generally, in all embodiments, the outer diameter of at least a portion of the clamp 80 is substantially constant but tapers inwardly toward the first end 82 of the clamp so as to define a first sloped/ramped surface 90 and/or toward the second end 84 of the clamp as well so as to define a second sloped/ramped surface 91. As is currently preferred, and as shown in FIGS. 1 and 2, the outer diameter of the clamp 80 tapers inwardly toward both the first end 82 and the second end 84 of the clamp. The angle of taper of the first sloped/ramped surface 90 can vary; however, it is currently preferred for it to be substantially constant and to be substantially complimentary to that of the sloped/ramped surface 50 of the driving member 40. Similarly, the angle of taper of the second sloped/ramped surface 91 can vary as well; however, it is currently preferred for it to be substantially constant and to be substantially complimentary to that of the sloped/ramped inner diameter surface 22 of the connector body 12.

In accordance with at least the exemplary embodiment of FIG. 1, the inner diameter of the bore 86 of the clamp 80 is shaped to include two valleys 92A, 92B defined between three peaks 94A, 94B, 94C. Specifically, valley 92A is defined between peaks 94A and 94B and valley 92B is defined between peaks 94B and 94C. Although not illustrated, the clamp 80 can instead include additional peaks 92 and/or valleys 94; however, regardless of the specific number of valleys 92 and peaks 94, each valley 92 should be sized and shaped to accommodate a peak 210 of a segment of an annular corrugated coaxial cable 200, whereas each peak 94 should be sized and shaped to accommodate a valley 220 of the segment of annular corrugated coaxial cable.

In accordance with at least the exemplary embodiment of FIG. 1, a recess 98 can be defined within a valley 92B of the clamp 80, wherein the recess is sized and shaped to accommodate a coiled element (e.g., a spring) 100. The specific location of the recess 98 can be within valley 92B as shown in FIG. 1 or, if desired, can be within another valley, can be at one of the peaks 94A, 94B, 94C, or can be elsewhere between the first end 82 and the second end 84 of the clamp 80. Alternatively, the spring 100 could be positioned between the connector body 12 and the clamp 80. Regardless of which of these positions is occupied by the spring 100, its presence enables the clamp 80 to more securely engage the segment of annular corrugated coaxial cable 200 as will be further described below.

As best illustrated in the exemplary embodiment of FIG. 2, the spring 100 is a ring-like element having a first end 102 and a second end 104, wherein a predetermined amount of space 106 is defined between the first end and the second end. This design of the spring 100 is advantageous because the first end 102 and the second end 104 are drawn together as radial pressure is exerted upon the spring while the connector 10—and thus the clamp 80—is being compressed. The radial pressure causes the space 106 between the first end 102 and the second end 104 of the spring 100 to be reduced or entirely eliminated, thus, in turn, causing a more secure engagement between the clamp (and hence the connector 10) and the segment of annular corrugated coaxial cable 200.

The connector 10 further includes a collet 110 and a spacer (e.g., an insulator) 120. The spacer 120 is positioned between the collet 110 and the body 12, such as in the FIG. 1 exemplary embodiment wherein the spacer is disposed around the collet so as to hold the collet in place. A first end 112 of the collet 110 provides the connection to the center conductor 202 of the inserted annular corrugated coaxial cable segment 200 to which the connector 10 is being connected, and the spacer 120 electrically insulates the collet from the connector body 12 and the conductive portions of the inserted cable segment.

As shown in FIGS. 1 and 2, the first end 112 of the collet is formed to include a plurality of flexible fingers or tines 114. In accordance with an exemplary embodiment of the connector 10, the collet fingers are flexible, and have a substantially constant inner diameter. The outer surface of each finger 114 is comprised of a first, firstmost diameter portion 116A, a second diameter portion 116B second to the first diameter portion 116A, a third diameter portion 116C second to the second diameter portion 116B, and a fourth, secondmost diameter portion 116D second to the third diameter portion 116C. The effective outer diameter of each collet finger 114 is greatest at the second diameter portion 161B and smallest at the fourth diameter portion 116D, wherein the outer diameter of the first diameter portion 116A and the outer diameter of the third diameter portion 116C are substantially equal to each other and are less than the outer diameter of the second portion 161B but greater than the outer diameter of the fourth portion 116D.

Optionally, and as shown in FIGS. 1 and 2, the connector can include a guide element 130 (e.g., a seizure bushing). The guide element 130 has a first end 132, a second end 134 and a bore 136 defined therebetween. As best shown in FIG. 1, the second end 134 of guide element 130 is in tactile communication with the connector body 12. The outer diameter of the guide element 130 tapers inwardly from its first end 132 to its second end 134 such that the guide element has a flared conical shape. By way of non-limiting example, and as shown in FIG. 1, the inner diameter of the bore 136 of the guide element 130 is substantially constant and is substantially identical to the outer diameter of the guide element at its second end 134. The diameter of the bore 136 also is greater than at least one of the diameter portions 116A-116D of the collet fingers 114. By way of non-limiting example, the diameter of the bore 136 is greater than that of the second diameter portion 116B of the collet fingers. Thus, as shown in FIG. 1, prior the connector 10 being compressed, only the first diameter portion 116A is disposed within the bore 136 of the guide element 130.

Referring now to FIG. 3, the connector 10 of FIG. 1 is shown after the segment of annular corrugated coaxial cable 200 has been inserted therein and has been compressed through use of a compression tool (not shown). The compression tool can be, by way of non-limiting example, a tool that includes two coaxially mounted driving bolts, wherein one driving bolt is placed against the housing 60 and the other against the spacer 120 and whereby the bolts are axially moved toward each other so as to cause the connector 10 to be compressed onto the cable segment 200.

As the connector 10 is compressed, the housing 60 is caused to be axially advanced in a direction away from the opening 11 of the connector 10 (i.e., toward the second end 16 of the body 12), thus, in turn, causing (a) the first shoulder 68 of the housing to contact and exert axial force upon the first end 72 of the intermediate member 70 in a direction away from the opening 11 of the connector 10 such that the second end 74 of the intermediate member exerts axial force against the first end 42 of the driving member 40 in a direction away from the opening 11 of the connector 10, and (b) the second shoulder 69 to contact and exert axial force against the ridge 48 of the driving member 40 in a direction away from the opening 11 of the connector 10. Individually and collectively these axial forces cause the driving member 40 to be axially advanced in a direction away from the opening 11 of the connector 10 and thus, in turn, cause the sloped surface 50 of the driving member 40 to be axially advanced in a direction away from the opening 11 of the connector 10 so as to be forced against the first complimentarily sloped surface 90 of the clamp 80. Moreover, these axial forces further cause the intermediate member 70 to be radially compressed against the outer jacket 204 of the cable segment, thus, in turn, providing added moisture sealing for the connector 10.

Also as the connector 10 is compressed, the second diameter portion 116B of each collet finger 114 is axially forced against the comparatively smaller diameter bore 136 of the guide element 130 in a direction toward the opening 11 of the connector 10. Due to this force and the flexible nature of the collet fingers 114, the second diameter portion 116B of each finger 106 is flexed inwardly so as to be forced into the bore 130. Then, the trailing third and fourth portions 116C, 116D of the fingers are advanced into the bore 136 as well. Once this has occurred, one or more of the diameter portions 116A-116D of the collet fingers 114 individually and/or collectively will exert a radial compressive force against the portion of the center conductor 202 that is within the bore 136 of the guide element 136 of the cable segment, thus causing that portion of the center conductor to become seized by/engaged to the connector 10. It is currently preferred for the difference in diameter between the second diameter portion 116B of each collet finger 114 and the bore 136 of the guide element 136 to be large enough such that the collet fingers, 114 are not damaged during this process, but also small enough such that once the larger diameter second portion 116B of each collet finger 114 is within the bore 136 of the guide element 130, a detent mechanism is created to inhibit unintended withdrawal of the collet fingers 114 from the guide element and thus to maintain the contact forces between the connector 10 and the center conductor 202 of the cable segment 200.

Thus, as the connector 10 is compressed, axial force is caused to be exerted against the clamp in a direction toward the opening 11 of the connector 10 and in a direction away from the opening of the connector. Individually and collectively these axial forces cause the clamp to be radially forced into engagement to/with the segment of annular corrugated coaxial cable 200. Specifically, the peaks 94A, 94B, 94C of the clamp 80 are caused to be securely engaged, respectively, to/within valleys 220A, 220B, 220C of the cable 200 and the peaks 210A, 210B of the cable 200 are caused to be securely engaged, respectively, to/within valleys 92A, 92B of the clamp 80. As noted above, the peaks 94 and valleys 92 of the clamp 80 are sized and shaped so as to conform to the size and shape of the peaks 210 and valleys 220 of the segment of coaxial cable 200.

The presence of the spring 100 ensures that the separated segments 80A, 80B, 80C of the clamp 80 are held widely apart prior to compression. That, in turn, facilitates proper matching of the clamp peaks 94 with the cable valleys 220 and the cable peaks 210 with the clamp valleys 92. Accordingly, following compression of the connector 10, the clamp 80 is snugly engaged to/with the cable segment 200 with maximum surface contact yet not so as to cause deformation of the cable segment, as could occur if the peaks and valleys of the cable and clamp were misaligned. Moreover, the presence of the spring 100 enables the cable 200 to be cut at a valley 220, rather than at a peak 210 as is conventionally done. That, in turn, simplifies the installation process, since it is comparatively easier for an installer to use a simple tool such as a knife, saw or other bladed instrument to track and make a cut at a valley 220.

Although is it desirable for the clamp 80 to be securely/snuggly engaged to the cable segment 200, such engagement should not be too tight lest the cable could be damaged, and, in turn, its signal quality be compromised. Two design considerations of the connector 10 ensure that an overly snug connection does not occur. First, the elastomeric composition of the intermediate member 70 ensures that enough, but not too much axial force is exerted upon the driving member 40 by the housing 60 in a direction away from the opening 11 of the connector 10. Second, the first end 14 of the body 12 acts as a stop to prevent the ridge 48 of the driving member 40 from being axially advanced too far in a direction away from the opening 11 of the connector 10.

Figure 4:
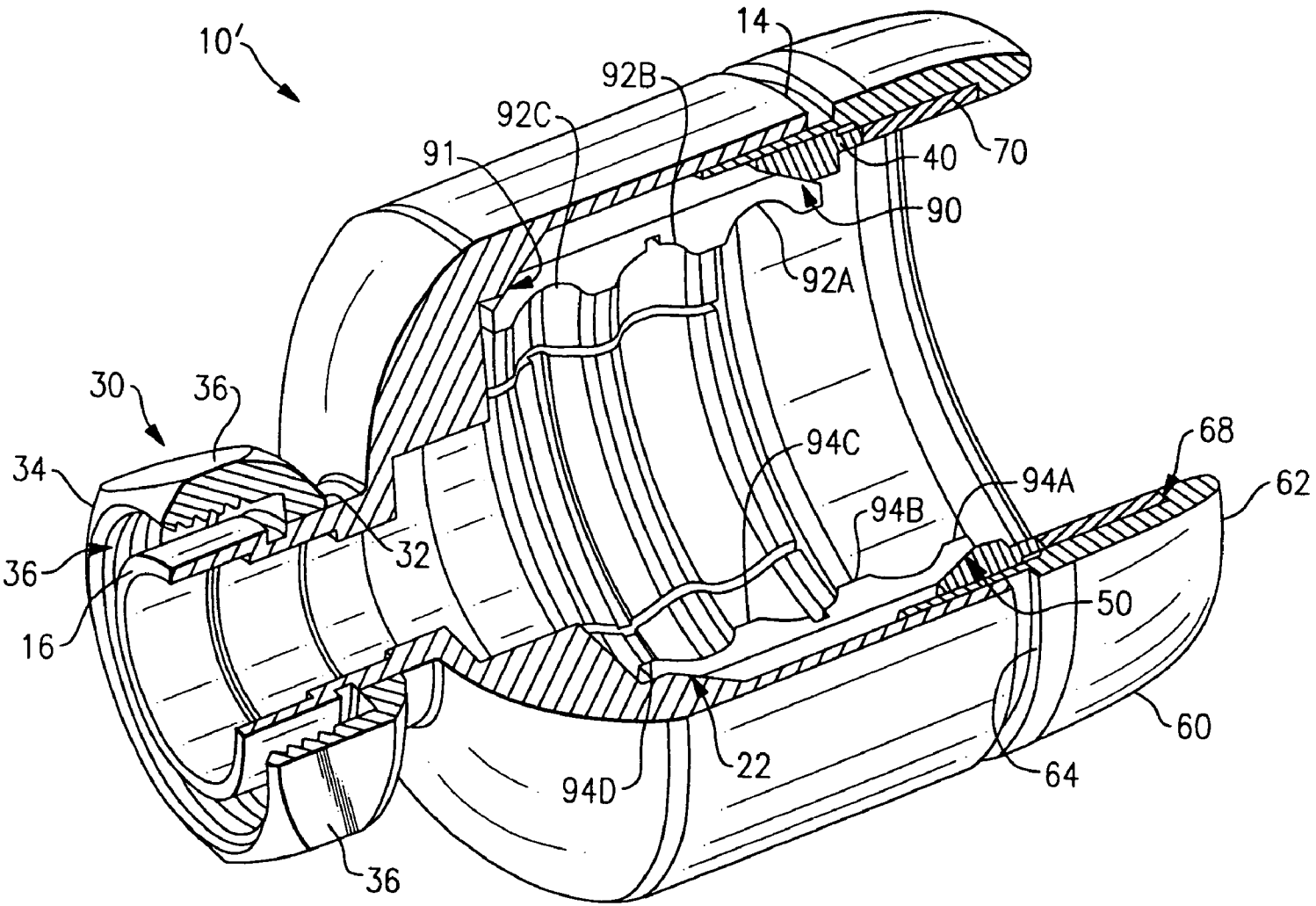
FIG. 4 is an alternate compression connector sized to accommodate a larger gauge segment of annular corrugated coaxial cable.

Referring now to FIG. 4, an alternate connector 10' is shown that is suitable for use with comparatively larger gauge cable than the connector 10 of FIGS. 1-3. The design and function of the FIG. 4 connector 10' are generally identical to the those of the connector 10 in FIGS. 1-3, including with regard to the collet 110, the insulator 120 and the guide element 130, each of which has been omitted (as has the segment of annular corrugated coaxial cable 200) in FIG. 4 for ease of viewing. However, as is currently preferred and as is illustrated in FIG. 4, the connector 10' includes at least four peaks 94A, 94B, 94C, 94D and at least three valleys 92A, 92B, 92C for the connector 10' so as to ensure a snug fit between the connector 10' and a segment of larger gauge annular corrugated coaxial cable.

The connectors 10, 10' described above generally can be connected to a cable segment 200 such that the connector can engage the center conductor 202 prior to engaging the peaks 210 and valleys of the outer conductor, or vice versa. However, without wishing to be bound by theory, it is believed that there can be benefits if the outer conductor of the cable segment 200 is seized/engaged prior to or while the center conductor 202 of the cable segment is being-engaged, since doing so could potentially prevent the sensitive center conductor of the cable segment (especially a 50 ohm cable segment) from being harmed during the process of engaging the outer conductor of the cable segment.

To that end, a tool (not shown) can be utilized in order to cause a connector 10, 10' to become engaged to/within the outer conductor of a cable segment 200 and then, only after connector has engaged the outer conductor, to seize/engage the center conductor 202 of the cable segment. An exemplary such tool is depicted and described in commonly owned and co-pending U.S. patent application Ser. No. 11/677,600, which was filed on Feb. 22, 2007. The tool is able to ensure that the center conductor of a cable segment is seized after the outer conductor of the cable segment is engaged due to the presence of a die spring or other like element of the tool. Only after the die spring is triggered or otherwise actuated can the necessary steps be taken to engage the center conductor of the cable segment. By way of example, the tool can be positioned and pre-set such that the die spring can be actuated only after a certain level of resistance is sensed, wherein this level of resistance would be set so as to be encountered only once the outer conductor of the cables segment is completely engaged.

Such a tool can be used in accordance with the embodiments of the connectors 10, 10' depicted and described herein. This can occur, e.g., by placing the tool in communication with three separate exemplary placement locations on the FIGS. 1-3 connector 10, namely a first exemplary placement location against the first end 62 of the compression member 60, a second exemplary placement location against the second end 16 of the body, and a third exemplary placement location at the second end 302 of a collet support element 300. Despite the differences between the FIG. 1 connector 10 and the FIG. 4 connector 10', the tool generally is placed in communication with the same three separate exemplary placement locations with regard to the FIG. 4 connector 10' as the FIG. 1 connector 10, namely a first exemplary placement location at the first end 62 of the compression member 60, a second exemplary placement location against the second end 16 of the connector body 12, and, although not shown, a third exemplary placement location at the second end (not shown) of a collet support element (not shown).

For each of such exemplary embodiments, the tool can apply axial force in a direction away from the opening 11 of the connector 10 at the first exemplary placement location, and axial force in a direction toward the opening 11 of the connector 10 at both the second exemplary placement location and the third exemplary placement location, each without requiring repositioning of the tool—that is, the tool is capable of simultaneously applying axial forces at each of the three exemplary placement locations. However, it would be disadvantageous for these forces to take effect simultaneously, since that could cause the center conductor 202 of a cable segment 200 to be seized prior to or at the same time as the outer conductor is engaged. That, in turn, and as noted above, could lead to the sensitive center conductor of the cable segment (especially a 50 ohm cable segment) being harmed during the process of engaging the outer conductor.

To address this potential problem, the tool is adapted to ensure that seizure of the center conductor 20 of cable 200 by the connector 10, 10' occurs only after the peaks 210 and valleys 220 of the outer conductor of the cable has been engaged. It is not necessary for the tool to be repositioned in order for this to occur; instead, the tool is simultaneously placed at each of its three exemplary placement locations and axial force is applied by the tool in a direction away from the opening of the connector 10, 10' at the first exemplary placement location, and in a direction toward the opening 11 of the connector 10, 10' at each of the second exemplary placement location and the third exemplary placement location. However, the tool includes a die spring or other like device to prevent application of axial force in a direction toward the opening 11 of the connector 10, 10' at the third exemplary placement location until after the outer conductor of the cable segment has been engaged by the connector 10, 10'. The tool can include a sensing element to determine when the outer conductor of a cable segment has been engaged by measuring or gauging the resistance provided by the connector against the tool during the process of engaging the outer conductor. As the peaks 210 and valleys 220 of the outer conductor of the cable segment 200 are being engaged, the resistance level will remain constant or will increase slowly. However, once the outer conductor of the cable segment 200 is fully engaged by the connector 10, 10', the resistance will increase sharply. The sensing device of the tool is calibrated to release the die spring once the resistance increases sharply as such, and the release of the die spring automatically allows the tool to apply its stored axial force in a direction toward the opening 11 of the connector 10, 10' at the third exemplary placement location. That, in turn, and as discussed above, causes the connector to seize at least a portion of the center conductor of the cable segment.

Although various embodiments have been described herein, it is not intended that such embodiments be regarded as limiting the scope of the disclosure, except as and to the extent that they are included in the following claims—that is, the foregoing description is merely illustrative, and it should be understood that variations and modifications can be effected without departing from the scope or spirit of the various embodiments as set forth in the following claims. Moreover, any document(s) mentioned herein are incorporated by reference in its/their entirety, as are any other documents that are referenced within such document(s).

I claim:

1. A compression connector for the end of an annular corrugated coaxial cable, the annular corrugated coaxial cable including a center conductor having a surrounding dielectric, the dielectric surrounded by an outer conductor in the form of a plurality of conductive peaks and a plurality of conductive valleys, the outer conductor being at least partially surrounded by a protective outer jacket, the compression connector having an opening and comprising:

a body having a first end, a second end and a bore defined therebetween;

a compression member having a first member end, a second member end and a member bore defined therebetween, wherein the second member end of the compression member is in sliding engagement with the body; and a clamping element having a clamping element bore disposed within the bore of the body, the clamping element comprising:

a plurality of through slots;

a plurality of peaks; and a plurality of valleys;

an intermediate member formed of an elastomeric material, wherein upon axial advancement of the compression member on the body the clamping element is caused to be compressed radially to an extent whereby at least one of the plurality of peaks of the clamping element becomes engaged within one of the plurality of valleys of the annular corrugated coaxial cable and whereby at least one of the plurality of peaks of the annular corrugated coaxial cable becomes engaged within one of the plurality of valleys of the clamping element so as to provide at least one contact force between the compression connector and the annular corrugated coaxial cable.

2. The compression connector of claim 1, wherein the second end of the body includes a connector interface selected from the group of connector interfaces consisting of a BNC connector, a TNC connector, an F-type connector, an RCA-type connector, a DIN male connector, a DIN female connector, an N male connector, an N female connector, an SMA male connector and an SMA female connector.

3. The compression connector of claim 1, wherein the bore of the body includes a sloped surface and the second end of the clamping element includes a sloped surface complimentary to the sloped surface of the body.

4. The compression connector of claim 1, wherein the clamping element includes at least three through slots.

5. The compression connector of claim 1, further comprising:

a nut surrounding the second end of the body.

6. The compression connector of claim 5, wherein the nut is hex-shaped.

7. The compression connector of claim 5, wherein the body includes a protruding ridge and wherein the nut is disposed against the protruding ridge.

8. The compression connector of claim 1, further comprising:

a driving member having a first end, a second end and a bore defined therebetween, wherein the driving member is disposed within the bore of the body.

9. The compression connector of claim 8, wherein the driving member includes a protruding ridge positioned so as to act as a stop for the first end of the body.

10. The compression connector of claim 8, wherein the bore of the driving member includes a sloped surface and the first end of the clamping element includes a sloped surface complimentary to the sloped surface of the driving member.

11. The compression connector of claim 1, further comprising:

a coiled element in communication with the clamping element, the coiled element having a first end, a second end, and a predetermined amount of space defined between the first end and the second end, wherein the predetermined amount of space is reduced as radial pressure is being exerted upon the coiled element.

12. The compression connector of claim 11, wherein a recess is defined within the clamping element and wherein the coiled element is disposed within the recess.

13. The compression connector of claim 12, wherein the recess is defined within a valley of the clamping element.

14. The compression connector of claim 1, wherein an intermediate member is disposed within the connector between the compression member and the driving member.

15. The compression connector of claim 14, wherein, upon a predetermined axial movement of the first end of the body in a direction away from the opening of the connector, the intermediate member is radially compressed so as to exert a force against the outer protective jacket of the annular corrugated coaxial cable.

16. The compression connector of claim 14, wherein the intermediate member is formed of a reversibly compressible material.

17. The compression connector of claim 16, wherein the intermediate member is formed of silicone rubber.

18. The compression connector of claim 1, further comprising:

a collet disposed within the bore of the body and adapted to receive the center conductor of the annular corrugated coaxial cable to establish electrical connectivity between the collet and the center conductor.

19. The compression connector of claim 18, further comprising:

a spacer disposed at a predetermined position between the collet and the body such that the center conductor of the annular corrugated coaxial cable is electrically isolated from the body.

20. The compression connector of claim 19, wherein the spacer is an insulator.

21. The compression connector of claim 18, further comprising:

a guide element disposed within the bore of the body, the guide element having a first end, a second end and a bore defined therebetween, wherein the bore of the guide element is sized to accommodate the center conductor of the annular corrugated coaxial cable and wherein the guide element is positioned within the bore of the body so as to guide the center conductor of the annular corrugated coaxial cable into the collet.

22. The compression connector of claim 21, wherein the guide element has an outer diameter that tapers inwardly from the first end of the guide element to the second end of the guide element.

23. The compression connector of claim 21, wherein the bore of the guide element has a substantially constant inner diameter, and wherein the substantially constant inner diameter of the bore is substantially equal to the outer diameter of the guide element at the second end of the guide element.

24. The compression connector of claim 21, wherein the guide element is a seizure bushing.

25. A compression connector for the end of an annular corrugated coaxial cable, the annular corrugated coaxial cable including a center conductor having a surrounding dielectric, the dielectric surrounded by an outer conductor in the form of a plurality of conductive peaks and a plurality of conductive valleys, the outer conductor being at least partially surrounded by a protective outer jacket, the compression connector having an opening and comprising:

a body having a first end, a second end and a bore defined therebetween;

a compression member having a first end, a second end and a bore defined therebetween, wherein the second end of the compression member is in tactile sliding engagement with the body;

a driving member having a first end, a second end and a bore defined therebetween, wherein the driving member is disposed within the bore of the body and adjacent to the compression member; and a clamping element disposed within the bore of the body, the clamping element comprising:

a first end;

a second end;

a bore defined between the first end and the second end of the clamping element;

a plurality of through slots;

a plurality of peaks; and a plurality of valleys;

an intermediate member formed of an elastomeric material, wherein upon axial advancement of the compression member in a direction away from the opening of the connector the clamping element is caused to be compressed radially by at least the driving member to an extent whereby at least one of the plurality of peaks of the clamping element becomes engaged within one of the plurality of valleys of the annular corrugated coaxial cable and whereby at least one of the plurality of peaks of the annular corrugated coaxial cable becomes engaged within one of the plurality of valleys of the clamping element so as to provide at least one contact force between the compression connector and the annular corrugated coaxial cable.

26. The compression connector of claim 25, wherein the bore of the body includes a sloped surface and the second end of the clamping element includes a sloped surface complimentary to the sloped surface of the body.

27. The compression connector of claim 25, wherein the bore of the driving member includes a sloped surface and the first end of the clamping element includes a sloped surface complimentary to the sloped surface of the driving member.

28. The compression connector of claim 25, wherein the driving member includes a protruding ridge positioned to act as a stop for the first end of the body.

29. The compression connector of claim 25, wherein the second end of the body includes a connector interface selected from the group of connector interfaces consisting of a BNC connector, a TNC connector, an F-type connector, an RCA-type connector, a DIN male connector, a DIN female connector, an N male connector, an N female connector, an SMA male connector and an SMA female connector.

30. The compression connector of claim 25, wherein the clamping element includes at least three through slots.

31. The compression connector of claim 25, wherein an intermediate member is disposed within the connector between the first end of the compression member and the first end of the driving member.

32. The compression connector of claim 31, wherein the intermediate member is formed of a reversibly compressible material.

33. The compression connector of claim 31, wherein, upon a predetermined axial movement of the first end of the body in a direction away from the opening of the connector, the intermediate member is radially compressed between the driving member and the compression member so as to exert a force against the outer protective jacket of the annular corrugated coaxial cable.

34. A compression connector for the end of an annular corrugated coaxial cable, the annular corrugated coaxial cable including a center conductor having a surrounding dielectric, the dielectric surrounded by an outer conductor in the form of a plurality of conductive peaks and a plurality of conductive valleys, the outer conductor being at least partially surrounded by a protective outer jacket, the compression connector having an opening and comprising:

a body having a first end, a second end and a bore defined therebetween;

a compression member having a first end, a second end and a bore defined therebetween, wherein the second end of the compression member is in sliding engagement with the body and wherein the compression member surrounds at least the first end of the body;

a driving member having a first end, a second end and a bore defined therebetween, wherein the driving member is disposed within the bore of the body;

an intermediate member formed of elastomeric material, said intermediate member having a first end, a second end and a bore defined therebetween, wherein the intermediary member is disposed within the bore of the body between the compression member and the driving member;

a clamping element disposed within the bore of the body, the clamping element comprising:

a first end;

a second end;

a bore defined between the first end and the second end of the clamping element;

a plurality of through slots;

a plurality of peaks; and a plurality of valleys, wherein upon axial advancement of the compression member in a direction away from the opening of the connector:

(a) the clamping element is caused to be compressed radially to an extent whereby at least one of the plurality of peaks of the clamping element becomes engaged within one of the plurality of valleys of the annular corrugated coaxial cable and whereby at least one of the plurality of peaks of the annular corrugated coaxial cable becomes engaged within one of the plurality of valleys of the clamping element so as to provide at least one contact force between the compression connector and the annular corrugated coaxial cable; and (b) the intermediate member is caused to be compressed radially between the compression member and the driving member to an extent so as to provide at least one contact force against the outer protective jacket of the annular corrugated coaxial cable.

35. The compression connector of claim 34, wherein the bore of the body includes a sloped surface and the second end of the clamping element includes a sloped surface complimentary to the sloped surface of the body.

36. The compression connector of claim 34, wherein the bore of the driving member includes a sloped surface and the first end of the clamping element includes a sloped surface complimentary to the sloped surface of the driving member.

37. A compression connector for the end of an annular corrugated coaxial cable, the annular corrugated coaxial cable including a center conductor having a surrounding dielectric, the dielectric surrounded by an outer conductor in the form of a plurality of conductive peaks and a plurality of conductive valleys, the outer conductor being at least partially surrounded by a protective outer jacket, the compression connector having an opening and comprising:

a body having a first end, a second end and a bore defined therebetween, wherein the bore of the body includes a sloped surface;

a compression member having a first end, a second end and a bore defined therebetween, wherein the second end of the compression member is in sliding engagement with the body and wherein the compression member surrounds at least the first end of the body;

a driving member having a first end, a second end and a bore defined therebetween, wherein the bore of the driving member includes a sloped surface, and wherein the driving member is disposed within the bore of the body;

an intermediate member formed of elastomeric material, said intermediate member having a first end, a second end and a bore defined therebetween, wherein the intermediary member is disposed within the bore of the body between the compression member and the driving member;

a clamping element disposed within the bore of the body, the clamping element comprising:

a first end having a sloped surface complimentary to the sloped surface of the driving member;

a second end having a sloped surface complimentary to the sloped surface of the body;

a bore defined between the first end and the second end of the clamping element;

a plurality of through slots;

a plurality of peaks; and a plurality of valleys, wherein upon axial advancement of the compression member in a direction away from the opening of the connector:

(a) the sloped surface of the first end of the clamping element is caused to contact the sloped surface of the driving member and the sloped surface of the second end of the clamping element is caused to contact the sloped surface of the body so as to collectively radially compress the clamping element to an extent whereby at least one of the plurality of peaks of the clamping element becomes engaged within one of the plurality of valleys of the annular corrugated coaxial cable and whereby at least one of the plurality of peaks of the annular corrugated coaxial cable becomes engaged within one of the plurality of valleys of the clamping element so as to provide at least one contact force between the compression connector and the annular corrugated coaxial cable; and (b) the intermediate member is caused to be compressed radially between the compression member and the driving member to an extent so as to provide at least one contact force against the outer protective jacket of the annular corrugated coaxial cable.

38. A compression connector for the end of an annular corrugated coaxial cable, the annular corrugated coaxial cable including a center conductor having a surrounding dielectric, the dielectric surrounded by an outer conductor in the form of a plurality of conductive peaks and a plurality of conductive valleys, the outer conductor being at least partially surrounded by a protective outer jacket, the compression connector having an opening and comprising:

a body having a first end, a second end and a bore defined therebetween;

a compression member having a first end, a second end and a bore defined therebetween, wherein the second end of the compression member is in sliding engagement with the body;

a collet disposed within the bore of the body and adapted to receive the center conductor of the annular corrugated coaxial cable to establish electrical connectivity between the collet and the center conductor;

a guide element disposed within the bore of the body, the guide element having a first end, a second end and a bore defined therebetween, wherein the bore of the guide element is sized to accommodate the center conductor of the annular corrugated coaxial cable and wherein the guide element is positioned within the bore of the body so as to guide the center conductor of the annular corrugated coaxial cable into the collet;

a spacer disposed at a predetermined position between the collet and the body such that the center conductor of the annular corrugated coaxial cable is electrically isolated from the body;

an intermediate member formed of an elastomeric material; and a clamping element disposed within the bore of the body, the clamping element comprising:

a first end;

a second end;

a bore defined between the first end and the second end of the clamping element;

a plurality of through slots;

a plurality of peaks; and a plurality of valleys, wherein upon axial advancement of the compression member in a direction away from the opening of the connector the clamping element is caused to be compressed radially to an extent whereby at least one of the plurality of peaks of the clamping element becomes engaged within one of the plurality of valleys of the annular corrugated coaxial cable and whereby at least one of the plurality of peaks of the annular corrugated coaxial cable becomes engaged within one of the plurality of valleys of the clamping element so as to provide at least one contact force between the compression connector and the annular corrugated coaxial cable.

39. The compression connector of claim 38, wherein the spacer is an insulator.

40. The compression connector of claim 38, wherein the guide element has an outer diameter that tapers inwardly from the first end of the guide element to the second end of the guide element.

41. The compression connector of claim 38, wherein the bore of the guide element has a substantially constant inner diameter, and wherein the substantially constant inner diameter of the bore is substantially equal to the outer diameter of the guide element at the second end of the guide element.

42. The compression connector of claim 38, wherein the guide element is a seizure bushing.

43. A compression connector for the end of an annular corrugated coaxial cable, the annular corrugated coaxial cable including a center conductor having a surrounding dielectric, the dielectric surrounded by an outer conductor in the form of a plurality of conductive peaks and a plurality of conductive valleys, the outer conductor being at least partially surrounded by a protective outer jacket, the compression connector having an opening and comprising:

a body having a first end, a second end and a bore defined therebetween;

a compression member having a first end, a second end and a bore defined therebetween, wherein the second end of the compression member is in sliding engagement with the body;

an intermediate member formed of an elastomeric material and a clamping element disposed within the bore of the body, the clamping element comprising:

a first end;

a second end;

a bore defined between the first end and the second end of the clamping element;

a plurality of peaks;

a plurality of valleys; and at least three clamping element segments separated from each other, wherein at least two of the three clamping element segments are separated from each other by at least one piece of material located between the first end of the clamping element and the second end of the clamping element, wherein upon axial advancement of the compression member in a direction away from the opening of the connector the clamping element is caused to be compressed radially to an extent whereby:

(a) at least one piece of material is broken apart such that a through slot is defined between the first end and the second end of the clamping element where the at least one piece of material was formerly located; and (b) at least one of the plurality of peaks of the clamping element becomes engaged within one of the plurality of valleys of the annular corrugated coaxial cable and whereby at least one of the plurality of peaks of the annular corrugated coaxial cable becomes engaged within one of the plurality of valleys of the clamping element so as to provide at least one contact force between the compression connector and the annular corrugated coaxial cable.

* * * * *